US007563497B2

(12) United States Patent
Ma

(10) Patent No.: US 7,563,497 B2
(45) Date of Patent: Jul. 21, 2009

(54) LIGHTWEIGHT, RIGID COMPOSITE STRUCTURES

(75) Inventor: Zheng-Dong Ma, Ann Arbor, MI (US)

(73) Assignee: MKP Structural Design Associates, Inc., Dexter, MI (US)

( * ) Notice: Subject to any disclaimer, the term of this patent is extended or adjusted under 35 U.S.C. 154(b) by 778 days.

(21) Appl. No.: 11/023,923

(22) Filed: Dec. 27, 2004

(65) Prior Publication Data

US 2006/0141232 A1 Jun. 29, 2006

(51) Int. Cl.
*B32B 29/00* (2006.01)

(52) U.S. Cl. ..... 428/86; 428/116; 442/312; 442/313; 442/314; 442/204; 442/205; 442/206; 442/207; 56/665; 56/649.1; 56/649.8

(58) Field of Classification Search ..... 442/312–314, 442/204–207; 428/116, 86; 56/665, 649.1, 56/649.8

See application file for complete search history.

(56) References Cited

U.S. PATENT DOCUMENTS

| | | | | | |
|---|---|---|---|---|---|
| 821,393 | A | | 5/1906 | Wright et al. | |
| 1,291,298 | A | * | 1/1919 | Walker | 52/649.1 |
| 2,763,586 | A | * | 9/1956 | Noyes | 428/140 |
| 2,831,655 | A | * | 4/1958 | Hammer | 254/129 |
| 3,298,152 | A | * | 1/1967 | Lockshaw | 52/649.6 |
| 3,555,131 | A | | 1/1971 | Weismann | |
| 3,751,869 | A | * | 8/1973 | McDonald et al. | 52/654.1 |
| 3,757,482 | A | * | 9/1973 | Haeussler | 52/405.3 |
| 3,857,645 | A | * | 12/1974 | Klein | 403/206 |
| 3,996,443 | A | | 12/1976 | Keller | 219/56 |
| 4,079,560 | A | | 3/1978 | Weismann | 52/309.7 |
| 4,137,354 | A | * | 1/1979 | Mayes et al. | 428/116 |
| 4,226,067 | A | | 10/1980 | Artzer | 52/309.12 |
| 4,268,560 | A | | 5/1981 | Maistre | 428/105 |
| 4,328,272 | A | | 5/1982 | Maistre | 428/105 |
| 4,395,615 | A | | 7/1983 | Tanenbaum | 219/79 |
| 4,448,832 | A | | 5/1984 | Kidwell | 428/113 |
| 4,472,086 | A | * | 9/1984 | Leach | 405/302.7 |
| 4,560,603 | A | * | 12/1985 | Giacomel | 428/86 |
| 4,606,961 | A | | 8/1986 | Munsen et al. | 428/119 |
| 4,614,013 | A | | 9/1986 | Stevenson | 29/155 |
| 4,690,850 | A | | 9/1987 | Fezio | 428/105 |
| 4,745,663 | A | * | 5/1988 | Crowson | 24/131 R |
| 4,836,084 | A | * | 6/1989 | Vogelesang et al. | 89/36.02 |
| 4,875,322 | A | | 10/1989 | Rozzi | 52/746 |
| 5,108,810 | A | | 4/1992 | Williams | 428/36.1 |
| 5,332,178 | A | | 7/1994 | Williams | 244/123 |
| 5,349,893 | A | * | 9/1994 | Dunn | 89/36.05 |
| 5,398,470 | A | | 3/1995 | Ritter et al. | 52/309.11 |
| 5,466,506 | A | | 11/1995 | Freitas et al. | 428/105 |
| 5,475,904 | A | * | 12/1995 | Le Roy | 28/108 |
| 5,582,893 | A | * | 12/1996 | B ottger et al. | 428/86 |
| 5,649,403 | A | | 7/1997 | Haisch | 52/693 |
| 5,651,633 | A | * | 7/1997 | Howe | 403/392 |
| 5,654,518 | A | * | 8/1997 | Dobbs | 89/36.02 |
| 5,674,585 | A | * | 10/1997 | Ewing et al. | 428/96 |
| 5,688,571 | A | | 11/1997 | Quigley et al. | 428/36.1 |
| 5,741,574 | A | * | 4/1998 | Boyce et al. | 428/119 |
| 5,746,765 | A | | 5/1998 | Kleshinski et al. | 606/198 |
| 5,804,277 | A | * | 9/1998 | Ashbee | 428/112 |
| 5,806,798 | A | | 9/1998 | Gillandt et al. | 244/123 |
| 5,869,165 | A | * | 2/1999 | Rorabaugh et al. | 428/105 |
| 5,904,025 | A | | 5/1999 | Bass et al. | 52/741.3 |
| 5,935,680 | A | | 8/1999 | Childress | 428/119 |
| 5,958,551 | A | * | 9/1999 | Garcia-Ochoa | 428/137 |
| 5,962,150 | A | | 10/1999 | Priluck | 428/596 |
| 5,981,023 | A | | 11/1999 | Tozuka et al. | 428/105 |
| 6,207,256 | B1 | * | 3/2001 | Tashiro | 428/178 |
| 6,237,297 | B1 | | 5/2001 | Paroly | 52/652.1 |

(Continued)

OTHER PUBLICATIONS

Literature Online Reference (http://lionreference.chadwyck.com/initRefShelfSearch.do?initialise=true&listType=mwd). Crisscross, Joint, & Panel. (8 pages total).*

(Continued)

*Primary Examiner*—Leszek Kiliman
(74) *Attorney, Agent, or Firm*—Gifford, Krass, Sprinkle, Anderson & Citkowski, P.C.

(57) ABSTRACT

Biomimetic tendon-reinforced" (BTR) composite structures feature improved properties including a very high strength-to-weight ratio. The basic structure includes plurality of parallel, spaced-apart stuffer members, each with an upper end and a lower end, and a plurality of fiber elements, each having one point connected to the upper end of a stuffer member and another point connected to the lower end of a stuffer member such that the elements form criss-crossing joints between the stuffer members. The stuffer members and fiber elements may optionally be embedded in a matrix material such as an epoxy resin. The fiber elements are preferably carbon fibers, though other materials, including natural or synthetic fibers or metal wires may be used. The stuffer members may be rods, tubes, or spheres, and may be constructed of metal, ceramic or plastic. The stuffer members are preferably spaced apart at equal distances. If the members are tubes, the fiber elements may be dressed through the tubes. Alternatively, the fiber elements may tied to the ends of the stuffer members and/or to each other at the joints. Both linear and planar structures are disclosed.

24 Claims, 11 Drawing Sheets

U.S. PATENT DOCUMENTS 6,268,049 B1 * 7/2001 Childress ..... 428/309.9
6,322,870 B1 * 11/2001 Tsai ..... 428/86
6,644,535 B2 11/2003 Wallach et al. ..... 228/173.5
6,645,333 B2 11/2003 Johnson et al. ..... 156/92
6,681,981 B2 * 1/2004 Paroly ..... 228/47.1
6,708,922 B1 3/2004 Hamilton ..... 244/30
2003/0017053 A1 1/2003 Baldwin et al. ..... 416/229

OTHER PUBLICATIONS

The Butterfly Project (2003). http://web.archive.org/web/20030831221712/http://www.teacherlink.org/content/science/class_examples/Bflypages/timlinepages/nosactivities.htm. (9 pages total).*

* cited by examiner

| | Weight (normalized) | Out-Plane Rigidity (normalized) | Strength (normalized) |
|---|---|---|---|
| Aluminum | 119% | 115% | 28 % |
| Lamina | 100% | 100% | 100 % |
| BTR | 63% | 69% | 106 % |

LIGHTWEIGHT, RIGID COMPOSITE STRUCTURES

FIELD OF THE INVENTION

This invention relates generally to composite structures and, in particular, to a biomimetic tendon-reinforced" (BTR) composite structures having improved properties including a very high strength-to-weight ratio.

BACKGROUND OF THE INVENTION

Composite structures of the type for military air vehicles are generally constructed from a standard set of product forms such as prepreg tape and fabric, and molded structures reinforced with woven or braided fabrics. These materials and product forms are generally applied in structural configurations and arrangements that mimic traditional metallic structures. However, traditional metallic structural arrangements rely on the isotropic properties of the metal, while composite materials provide the capability for a high degree of tailoring that should provide an opportunity for very high structural.

There is general confidence among the composite materials community that a high-performance all-composite lightweight aircraft can be designed and built using currently available manufacturing technology, as evidenced by aircraft such as the F-117, B-2, and AVTEK 400. However, composite materials can be significantly improved if an optimization tool is used to assist in their design. In the recent past, engineered (composite) materials have been rapidly developed [1-3]. Maturing manufacturing techniques can easily produce a large number of new improved materials. In fact, the number of new materials with various properties is now reported to grow exponentially with time [1].

Today an engineer has a menu of 40,000 to 80,000 materials at his/her disposal [4]. This means that material selection, for example when designing a new air vehicle, can be quite a difficult and complex task. On the other hand, the material that suits best the typical needs of a future air vehicle structure may still not be available. This is because new materials are currently developed based on standard material requirements rather than on those for future air vehicles. Therefore, two critical needs exist: 1) to develop an engineering tool that can assist designers in selecting materials efficiently in future air vehicle programs; 2) to develop a methodology that allows structural designers to design the material that meets best the lightweight and performance requirements of future air vehicle systems. A materials engineer will then identify the most suitable manufacturing process for fabricating such a material. This will ensure that the designer of future air vehicles is truly using the best material for his/her design, and that the new material developed by the materials engineer will meet the needs of the vehicle development program.

Topology optimization has been considered a very challenging research subject in structural optimization [5]. A breakthrough technique for the topology optimization of structural systems was achieved at the University of Michigan in 1988 [6], and it is known worldwide as the homogenization design method. In this approach, the topology optimization problem is transformed into an equivalent problem of "optimum material distribution," by considering both the "microstructure" and the "macrostructure" of the structure at hand in the design domain. The homogenization design method has been generalized to various areas, including structural design and material design [7]. It has also been applied to the design of structures for achieving static stiffness [6, 8-9], mechanical compliance [10-12], desired eigenfrequencies [13-16], and other dynamic response characteristics [17-20]. By selecting a modern manufacturing process, new materials may become truly available, with tremendous potential applications. These examples demonstrate that the topology optimization technique can be used to design new advanced materials—materials with properties never thought possible.

[1] Material density is defined as the ratio of the area filled with material to the area of the whole design domain.

In general, a main structure may have several functions: 1) support the weight of other vehicle structures, 2) resist major external loads and excitations, 3) absorb low-frequency shock and vibration, 4) manage impact energy. Also, the main structure in different parts of an air vehicle may play different roles, and the secondary structure of the air vehicle may in general have completely different functions, for instance ones related to aerodynamics, local impact, and isolation from high-frequency vibration and noise. Therefore, the materials used in the various parts of the vehicle need to be designed according to their primary functions.

Theoretically, an infinite number of engineered materials can be obtained through a given design process if no objective is specified for the use of the structure in the air vehicle system. In other words, engineered materials need to be designed in such a way that they are optimum for their functions in the air vehicle system and for the operating conditions they will experience.

SUMMARY OF THE INVENTION

This invention improves upon the existing art by providing a biomimetic tendon-reinforced" (BTR) composite structure with improved properties including a very high strength to weight ratio. The basic structure includes plurality of parallel, spaced-apart stuffer members, each with an upper end and a lower end, and a plurality of fiber elements, each having one point connected to the upper end of a stuffer member and another point connected to the lower end of a stuffer member such that the elements form criss-crossing joints between the stuffer members.

The stuffer members and fiber elements may optionally be embedded in a matrix material such as an epoxy resin. The stuffer members are preferably spaced apart at equal distances or at variable distances determined by optimizations processes such as FOMD discussed below. If the members are tubes, the fiber elements may be dressed through the tubes. Alternatively, the fiber elements may be tied to the ends of the stuffer members and/or to each other at the joints.

In terms of materials, although specific compositions are discussed with reference to preferred embodiments, the fibers can be made of carbon fibers, nylon, Kevlar, glass fibers, plant (botanic) fibers (e.g. hemp, flax), metal wires or other suitable materials. The stuffer members can take the form of rods, tubes, spheres, or ellipsoids, and may be constructed of metal, ceramic, plastic or combinations thereof. The matrix material can be epoxy resin, metallic or ceramic foams, polymers, thermal isolation materials, acoustic isolation materials, and/or vibration-resistant materials.

Both linear and planar structures may be constructed according to the invention. For example, the stuffer members may be arranged in a two-dimensional plane, with the structure further including a panel bonded to one or both of the surfaces forming an I-beam structure. Alternatively, the stuffer members are arranged in two-dimensional rows such that the ends of the members collectively define an upper and lower surface, with the structure further including material bonded to one or both of the surfaces. A solid panel, a mesh panel, or additional fiber elements may be utilized for such purpose.

DETAILED DESCRIPTION OF THE INVENTION

This invention uses a methodology called "function-oriented material design," or FOMD to design materials for the specific, demanding tasks. In order to carry out a FOMD, first the functions of a particular structure are explicitly defined, such as supporting static loads, dissipating or confining vibration energy, or absorbing impact energy. Then these functions need to be quantified, so as to define the objectives (or constraint functions) for the optimization process. Additional constraints, typically manufacturing and cost constraints, may also need to be considered in the optimal material design process. A major objective of this invention is to quantify these constraints and find ways to improve the optimization process for producing engineered materials that are cost-effective and can be manufactured.

Figure 1:
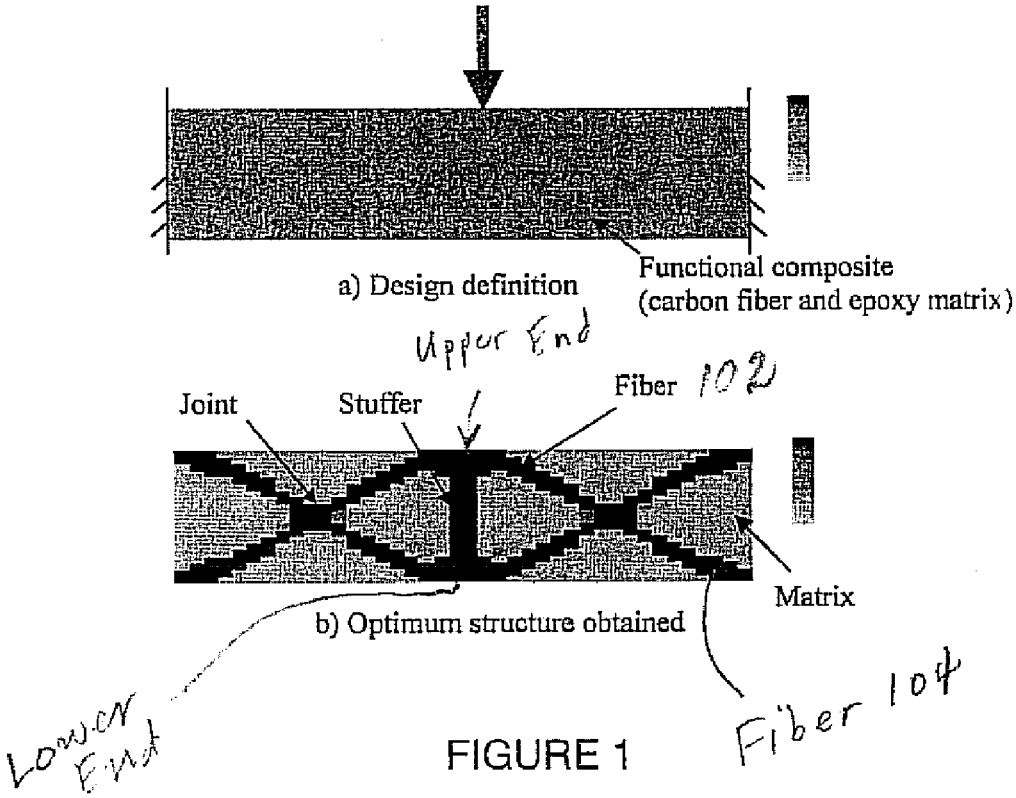
FIG. 1A depicts the definition of a design problem to be solved by the invention.
FIG. 1B depicts an optimized structural composite having several key components, including fibers, stuffers, and joints.

Among other applications, FOMD may be used to design and develop what we call "biomimetic tendon-reinforced" (BTR) composite structures. The goal here is to optimize the strength of beam and panel components for a given amount of fiber and other raw materials. As an initial study, a static load was applied at the middle of a beam fixed at its two ends. FIG. 1A depicts the definition of the design problem. The objective function considered in the optimization problem is to minimize the total strain energy stored in the composite. This is equivalent to maximizing the out-of-plane stiffness (resisting the out-of-plane load) as well as maximizing the overall out-plane strength in a global sense. The constraint function selected in the optimization problem is the total amount of fiber material used to build the composite.

Figure 2:
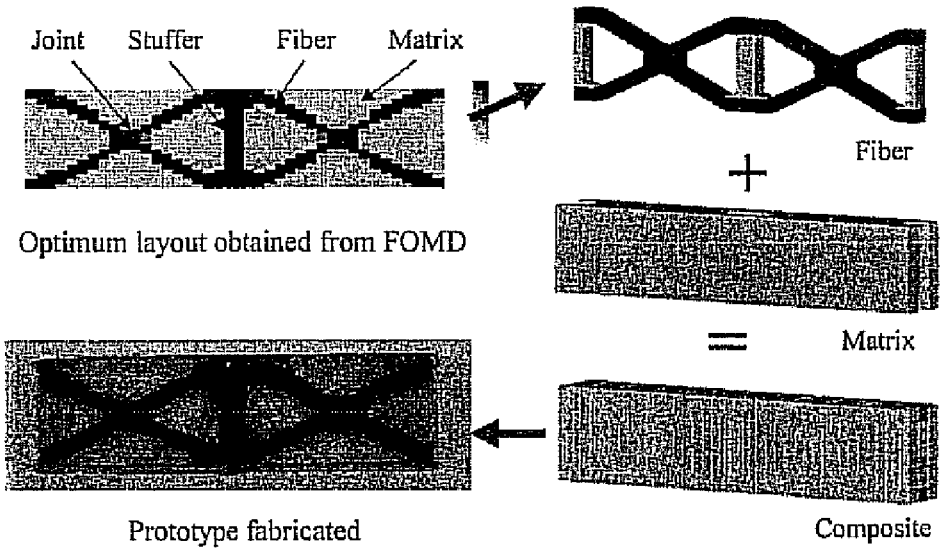
FIG. 2 shows how a matrix may be used to enhance strength.
Figure 7:
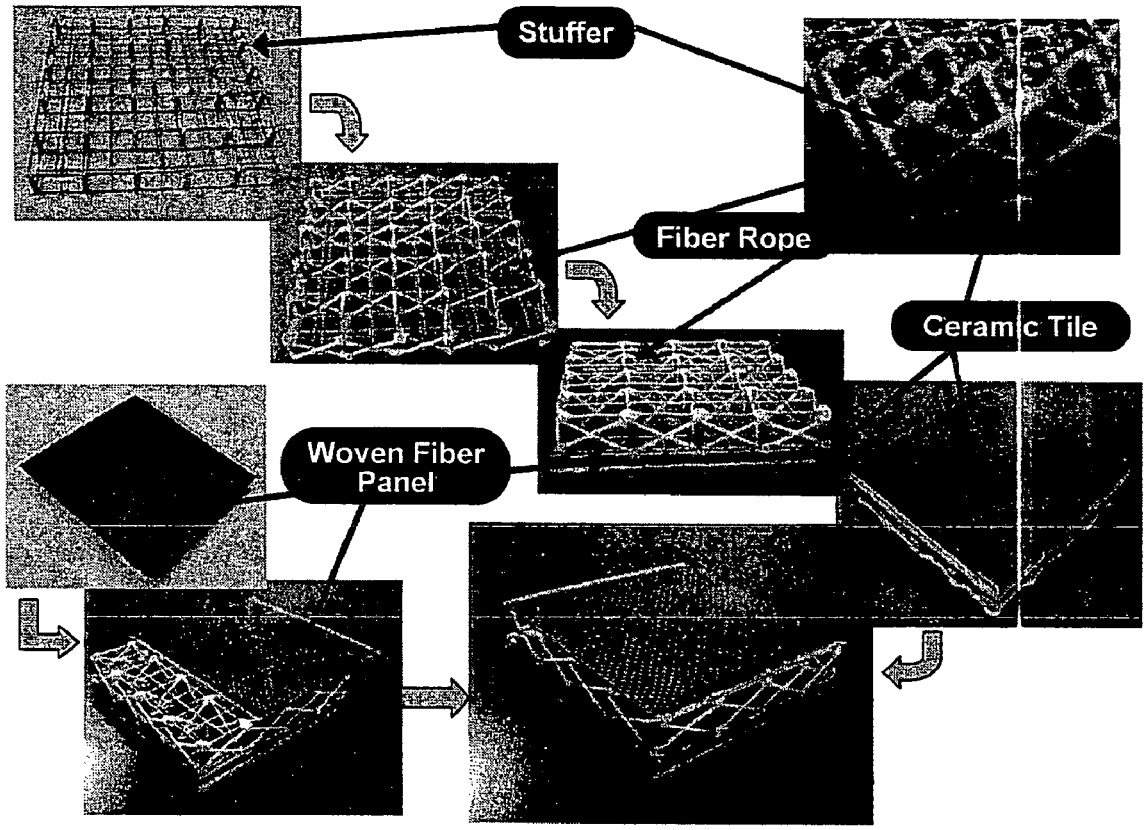
FIG. 7 illustrates an extension of the BTR concept to develop a composite armor, which consists of stuffer, fiber ropes, woven fiber panels, and ceramic layers.
Figure 8:
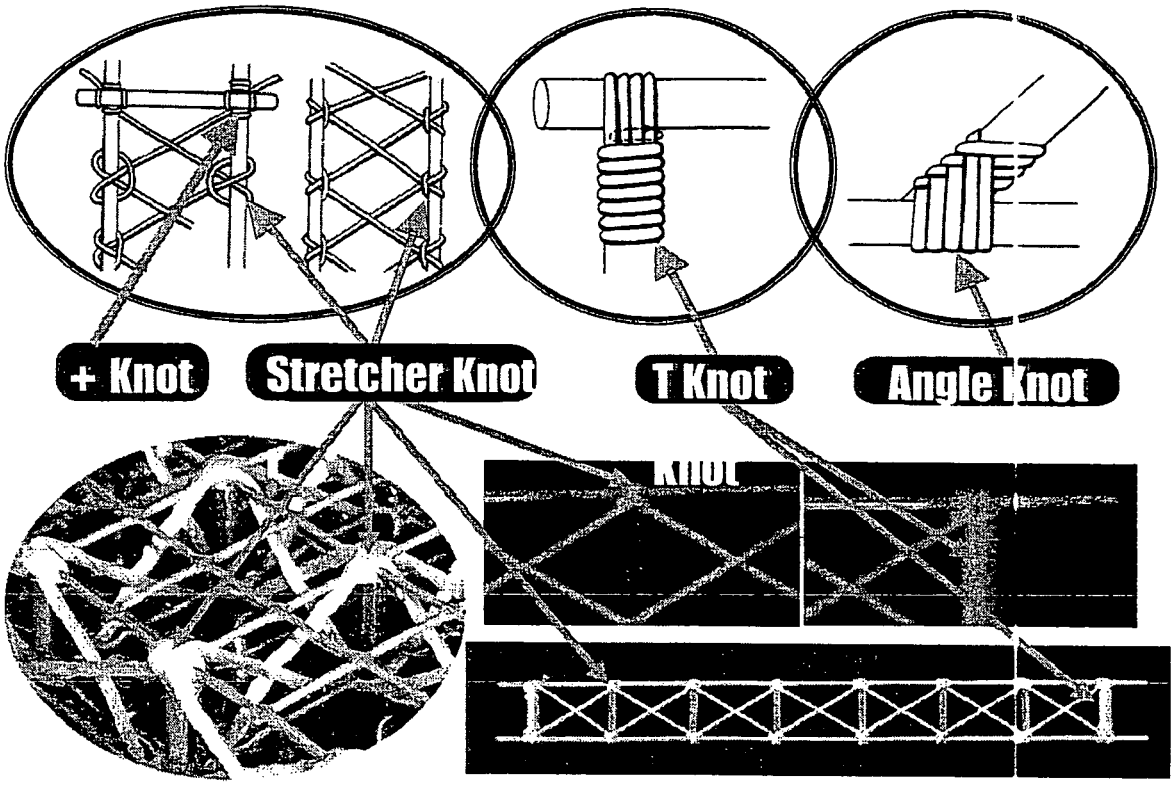
FIG. 8 illustrates potential knot designs for assembling different fiber-rope composites.

FIG. 1B shows the optimum layout of the composite obtained using FOMD code. Note that in this embodiment the total area occupied by the fibers was one third of that of the design domain. As shown in FIG. 1B, fiber 102 connects to the upper end of the stuffer, whereas fiber 104 connects to the lower end of the same stuffer, such that the fibers criss-cross between the stuffers, as shown in FIG. 2. The fibers may be tied where the cross, resulting in a joint, as shown in FIG. 1B, and/or the fibers may be tied to the ends of the stuffers, as best seen in FIGS. 7 and 8.

The optimum structural configuration of the composite has several key components, including: fiber, stuffer, and joint, as shown in FIG. 1B. Note that the optimum structure obtained from the concept design implies that the fibers should be concentrated and optimally arranged along the load paths where the reinforcements are most needed. Unlike traditional woven materials, in which the fibers are almost evenly distributed in one plane in the matrix materials, the new material will be reinforced by allocating concentrated fibers, such as fiber ropes, along load paths so as to increase transverse stiffness. In some applications, a matrix may be used to enhance strength, as shown in FIG. 2.

A preferred embodiment of this new material is called a "biomimetic tendon-reinforced" (BTR) composite structure, which includes five fundamental components: tendons/muscles (represented by fiber cables and/or actuators), ribs/bones (represented by metallic, ceramic, or other stuffers and struts), joints (including knots), flesh (represented by filling polymers, foams, thermal and/or acoustic materials, etc.), and skins (represented by woven composite layers or other thin covering materials.)

Figure 3:
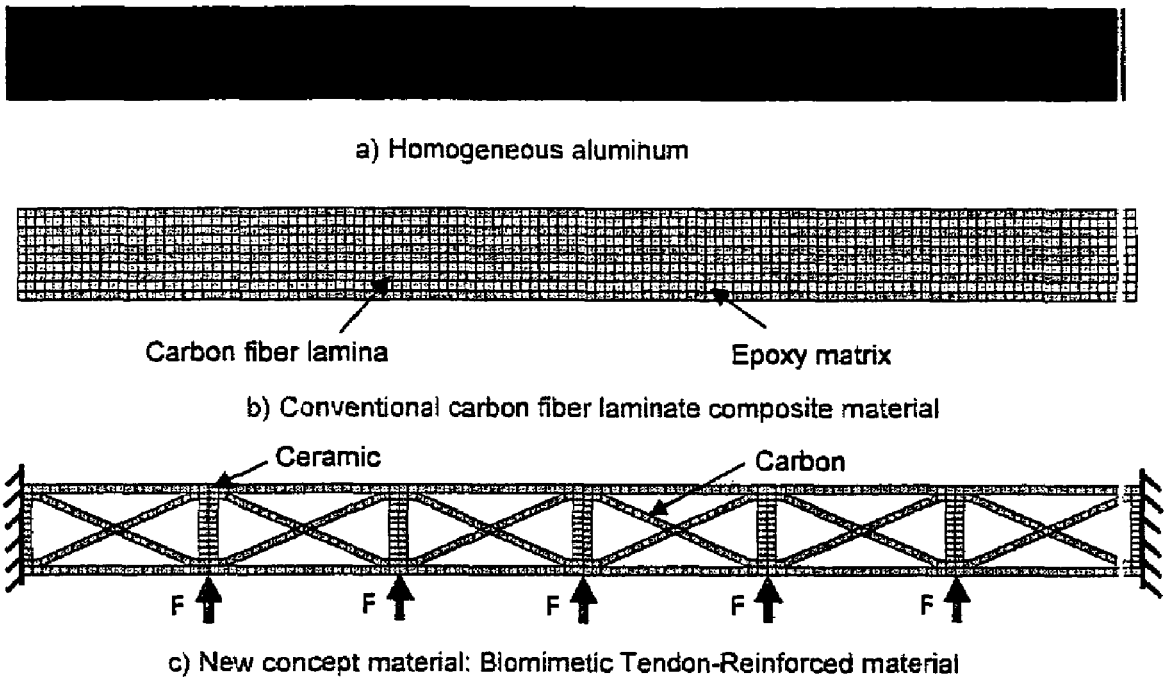
FIG. 3 compares the mechanical performances of the BTR with two traditional materials including aluminum and laminate fiber-reinforced polymer.

FIG. 3 compares the mechanical performances of the BTR (FIG. 3C) with two traditional materials including aluminum (FIG. 3A) and laminate fiber-reinforced polymer (FIG. 3B). It is seen that the new BTR material can reduce the weight by 37% compared to the laminate fiber-reinforced polymer, and by an additional 19% compared to the aluminum. In meanwhile, the new BTR material can improve the strength by 6% compared to the laminate fiber-reinforced polymer, and by more than three-times compared with the aluminum. Note that much more weight saving can be obtained when a three-dimensional BTR material is considered.

Figure 4:
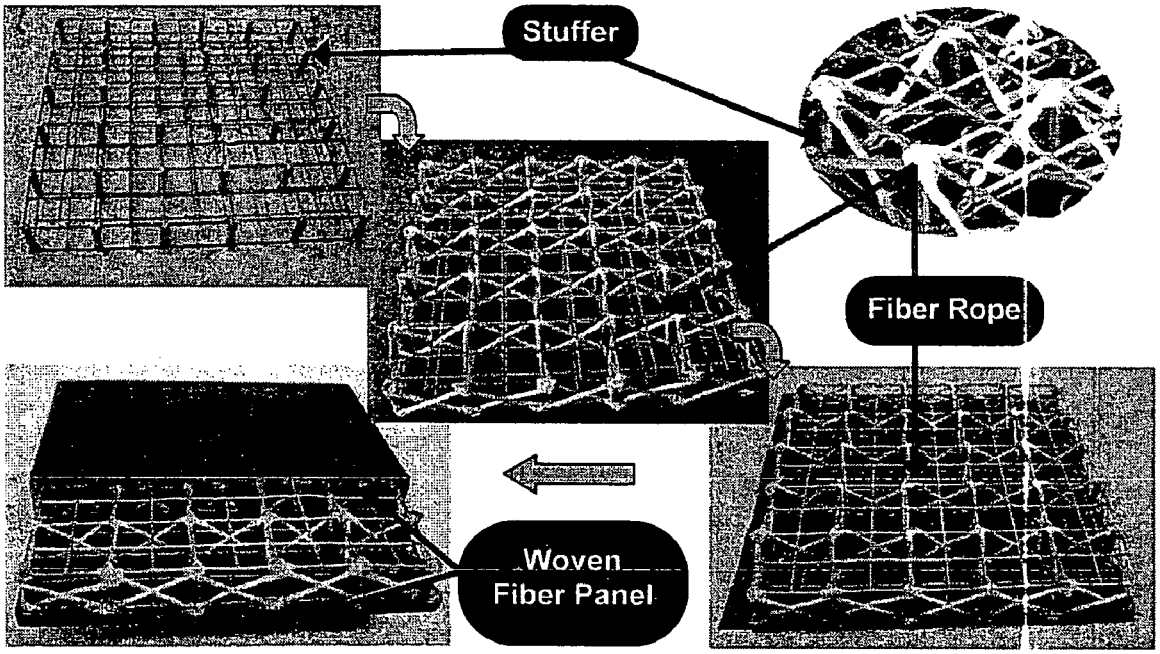
FIG. 4 illustrates a three-dimensional lattice material.
Figure 5:
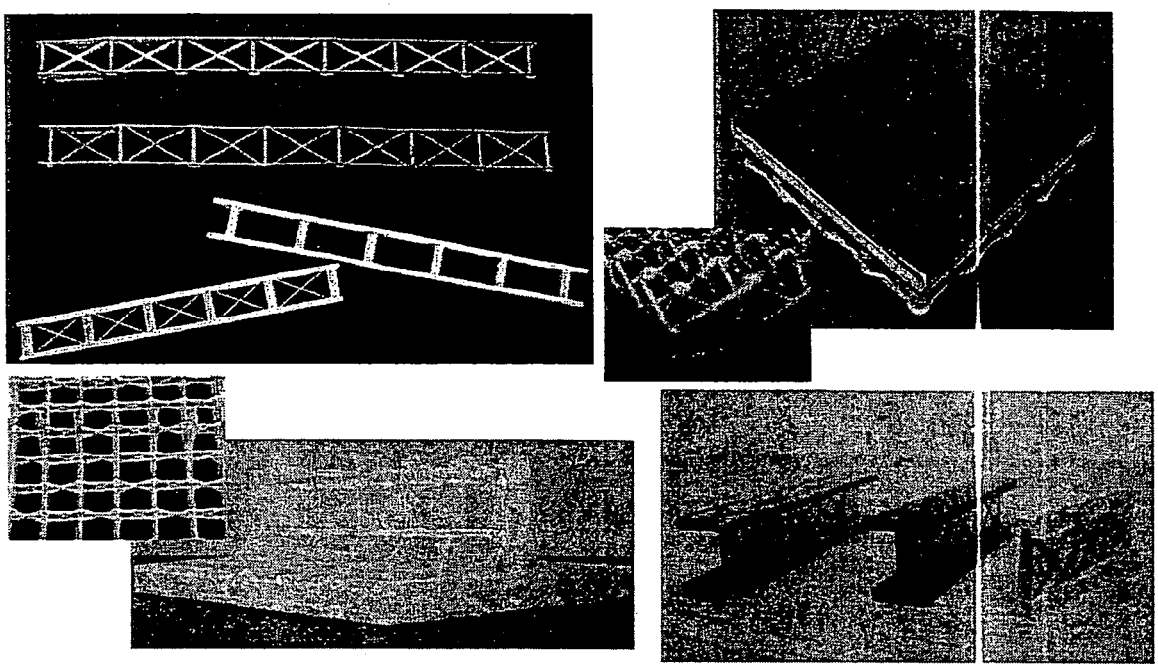
FIG. 5 further illustrates other structures using the basic BTR idea.

According to an alternative embodiment, the two-dimensional material concept has been extended to a three-dimensional lattice material, as shown in FIG. 4. The preferred structure is made of steel frame, steel columns, carbon-fiber ropes, and carbon fiber/epoxy cover panels. A potential fabrication procedure is also shown in FIG. 4. FIG. 5 further illustrates other structures using the basic BTR idea.

Figure 6:
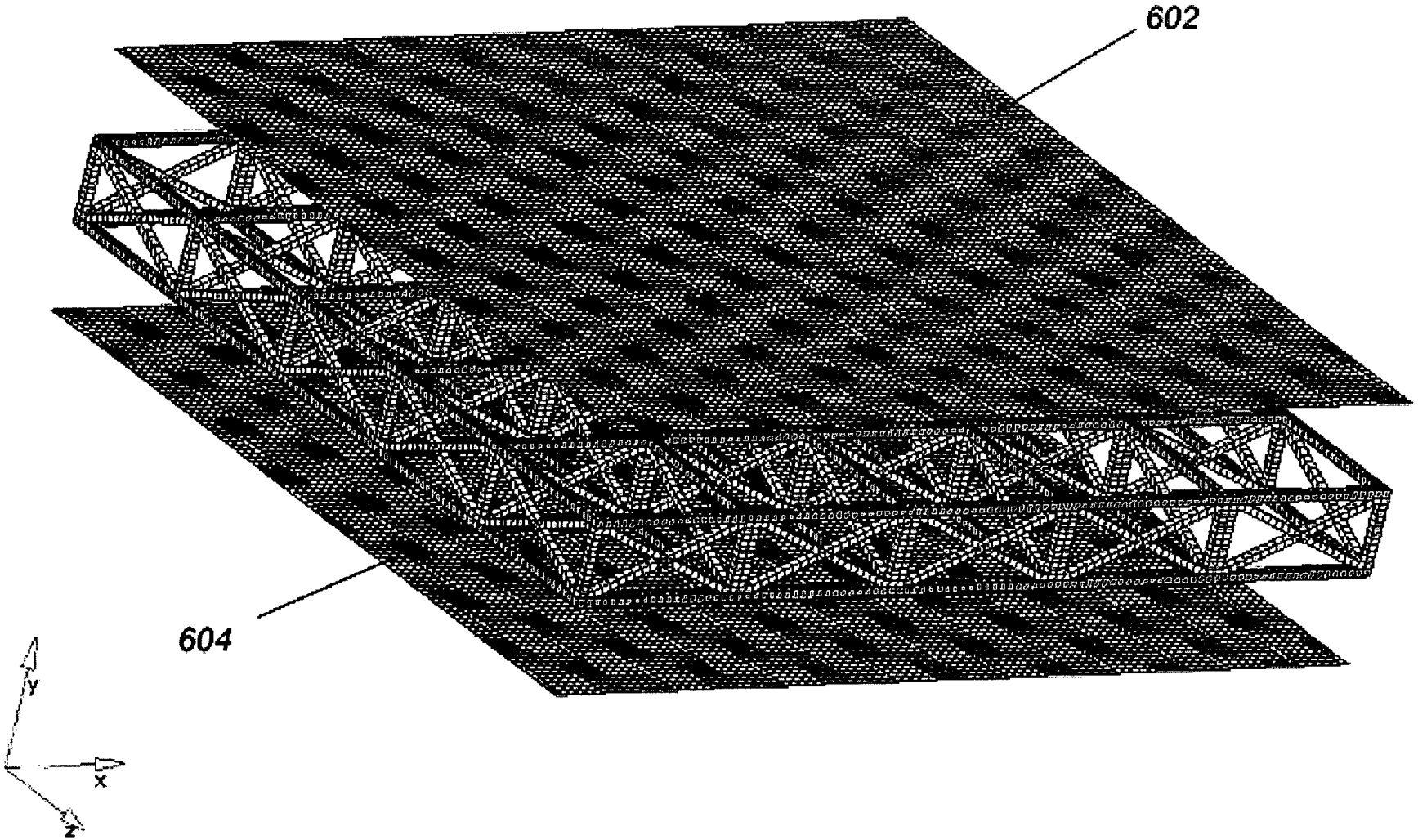
FIG. 6 depicts a finite element model of the BTR material shown in FIG. 4.

A finite element model of the BTR material shown in FIG. 4 is shown in FIG. 6. Tiles 602, 604 represent the carbon fiber/epoxy panel layers. The frames and columns are made of steel, and the fibers are carbon fiber ropes. The panels are glued to the frames using epoxy to form the final BTR structure as shown in FIG. 4. The dimension of the sample lattice structure is 100 mm×100 mm×12 mm. Note that commercial FEA code can provide an estimate for the response of the BTR under various loads.

In this example composite, the material properties for the steel are: Young Modulus=200 GPa, Poisson's Ratio=0.3, Density=7,800 Kg/m$^3$. For the carbon fiber ropes, the tensile modulus is 231 GPa, the cross section area is 1.0 mm$^2$, the density is 1,800 Kg/m$^3$. For the carbon fiber/epoxy panels, the tensile modulus in the carbon fiber direction is 231 GPa (along the x and z-directions in FIG. 21). For the epoxy layers, Young's modulus=18.6 GPa, Poisson's ratio=0.3. The thickness of each (fiber and epoxy) layer is set as 1 mm. The density of the panels is assumed to be 2,930 Kg/m$^3$.

TABLE 1

Mass distribution in the BTR material

| | Volume (mm$^3$) | Density (kg/mm$^3$) | Mass (kg) |
|---|---|---|---|
| Panel | 20,000 | 2.93E−6 | 0.0586 |
| Frame | 7,200 | 7.8E−6 | 0.0562 |
| Column | 480 | 7.8E−6 | 0.0037 |
| Fiber rope | 2,364 | 1.8E−6 | 0.0043 |
| Total | | | 0.1228 |

TABLE 2

The mechanical property of the BTR material

| | Case | BTR Structure | Aluminum Plate with Equivalent Weight | Steel Plate with Equivalent Weight |
|---|---|---|---|---|
| In-plane property | Tensile modulus | 43.2 GPa | 72.1 GPa | 205.9 GPa |
| | Compression modulus | 5.23 GPa | 72.1 GPa | 205.9 GPa |
| | Shear modulus | 1.06 GPa | 8.64 GPa | 24.85 GPa |
| Out-of-plane property | Simple supported bending stiffness | 7,339 N/mm | 3,912 N/mm | 514.5 N/mm |
| | Cantilevered bending stiffness | 1,482 N/mm | 192.1 N/mm | 22.57 N/mm |
| | Torsion stiffness | 2.827E6 N-mm/rad | 1.161E5 N-mm/rad | 1.449E5 N-mm/rad |

Commercial finite element analysis software, ABAQUS, was used to study the mechanical properties of the BTR structure. Note that the carbon-fiber rope was modeled as an asymmetric material, which has different properties at tension and compression. When the fiber is under tension, the carbon-fiber tensile modulus is used, when the fiber is in compression, the epoxy material property is used.

Table 1 illustrates the mass distribution in the BTR material model. From Table 1, the laminar panels and the frames are dominant in the total mass of the material. Dividing by the total volume occupied by the structure, which is 1.2E5 mm$^3$, the effective density of the material is 1,023 Kg/m$^3$, which is much smaller than the existing competing materials.

The mechanical properties of the BTR material are summarized in Table 2. The in-plane mechanical property is a mixture of the strong tensile modulus and the relatively weak compression and shear modulus. Additional fiber ropes and stuffers may be needed to increase the shear and compression stiffness of the BTR material, which will be studied in the future. It is interesting to note that even the relatively weak shear modulus, 1.06 GPa, is much higher than the Young's modulus of typical Aluminum foam, which is 0.45 GPa. The out-of-plane properties of the BTR material are also summarized in Table 2, which are obtained through the virtual prototyping procedure discussed in the next section. The bending and torsion stiffness can be further increased by inserting properly more fiber ropes in the structure. The increased total weight by doing this will be minimal due to the small fraction of the fiber rope weight in the BTR material (see Table 1).

In Table 2, the in-plane and out-of-plane mechanical properties of the BTR structure are also compared to the mechanical properties of the aluminum plate and steel plate with a equivalent weight. The steel plate and the aluminum plate have the same surface dimension, 100 mm×100 mm, as the BTR structure shown in FIG. 6. The thickness of the steel plate and the aluminum plate is 1.64 mm and 4.74 mm, respectively, to make an equivalent weight. It is seen that the out-of-plane stiffness of the BTR structure is much better than that of the two metallic structures. The in-plane tensile modulus of the BTR structure is 60% of that of the aluminum plate. The in-plane compression and torsion modulus of the BTR structure can be increased by inserting additional fiber ropes and stuffers, if these in-plane properties are important in applications.

One additional advantage of the BTR material is the potential multi-stage stability. When some part of the composite material is damaged (for instance, the steel frame is broken), the fiber rope can act as the safety member to keep the integrity of the grid structure if it is properly placed. This feature will be further studied in the future as a subject of how to optimally use waiting elements in the structure.

Based upon extensive virtual prototyping of the BTR material, the following conclusions were obtained:

1. The in-plane mechanical properties depends on the laminar panels and the steel frame.
2. The out-of-plane bending flexural rigidity is highly dependent upon the reinforce carbon fiber ropes. The bending stiffness is determined by the layout of the carbon fiber net.
3. The reinforce carbon fiber net is effective to strengthen the out-of-plane stiffness. Another advantage of the proposed BTR concept is the ultra-light weight, as it is discussed in the previous section (see also Table 1).

From the stress distribution obtained through finite element (FE) analysis, the maximum stress for each component of the BTR is listed in Table 3. Besides the maximum stress, the percentage of the maximum stress referred to the corresponding yield stress is listed in bracket. The yield stress, $\sigma_y$, for the steel frame and column is 770 MPa. The permitted tensile stress of the fiber rope is 3,800 MPa, while the compression stress is 313 MPa. The compression strength of the fiber rope is determined by the matrix material (epoxy). For the laminar panel, the permitted tensile stress is 1,930 MPa, and the permitted compression stress is 313 MPa. The percentage of the maximum stress to the yield stress of each component indicates the strength of that individual component. The higher the maximum stress percentage is, the lower the strength is. In Table 3, the component with the weakest strength is shown in red for each load case. It is seen that all components should be designed to have an equal strength. For a practical application of the propose BTR structure, the steel frame and the column shall be made as strong as possible.

TABLE 3

Maximum stress of each component in the BTR structure for in-plane and out-of-plane loads

| Case | | Max Stress $\sigma_{max}$ (MPa) (Max Stress Percentage $\sigma_{max}/\sigma_y$, %) | | | |
|---|---|---|---|---|---|
| | | Steel Frame | Steel Column | Composite Panel | Fiber rope |
| In-plane | Tensile | 6.68 (0.87) | 5.36 (0.7) | 8.38 (0.43) | 7.33 (0.19) |
| | Compression | 53.1 (6.9) | 19.4 (2.52) | 7.53 (2.41) | 5.79 (1.85) |
| | Shear | 88.2 (11.45) | 47.9 (6.22) | 117 (6.06) | 70.9 (1.87) |
| Out-of-plane | Bending (Simple-Supported) | 220 (28.57) | 239 (31.04) | 201 (10.41) | 465 (12.24) |
| | Bending (Cantilevered) | 315 (40.91) | 335 (43.51) | 379 (19.64) | 632 (16.63) |
| | Torsion | 11.2 (1.45) | 10.3 (1.34) | 9.74 (0.5) | 21.9 (0.58) |

In Table 4, the strength of the BTR structure is compared to the steel aluminum plates with equivalent weight. For each load case, the strength of the BTR structure is determined by the weakest component strength listed in Table 3. For the steel plate or the aluminum plate, the strength is determined by the maximum von Mises stress divided by the yield stress. The yield stresses are 770 MPa and 320 MPa for steel and aluminum, respectively. In Table 4, the relative strength is normalized to the strength of the Aluminum plate. It is seen that the strength of the BTR structure is much better than the strength of the two metallic plates in all load cases except the compression load case. In the out-of-plane load cases, the BTR structure can provide superior mechanical strength over the conventional metallic plate structure. Note that the steel plate is yielded in the two bending cases under the given loads, and the aluminum plate is yielded in the cantilevered bending case. Also note that performance of the BTR structure can be further improved by employing an optimization process to optimize the sizes of each component.

TABLE 4

Comparison of the relative strength for BTR structure, Aluminum Plate, and Steel Plate

| Case | | Relative Strength | | |
|---|---|---|---|---|
| | | BTR Structure | Aluminum Plate | Steel Plate |
| In-plane | Tensile | 233% | 100% | 87% |
| | Compression | 30% | 100% | 87% |
| | Shear | 106% | 100% | 85% |
| Out-of-plane | Bending (Simple-Supported) | 133% | 100% | 25% (yielded) |
| | Bending (Cantilevered) | 313% | 100% (yielded) | 29% (yielded) |
| | Torsion | 123% | 100% | 30% |

The first ten free vibration modes of the BTR structure have been predicted using the commercial FEA software ABAQUS. In these 10 modes, some are the panel dominant modes, such as the bending modes, and the in-plane elongation mode, while the others are the local modes with deformations in the fiber ropes and the steel frame. Since the actual BTR structure is inherently nonlinear due to the asymmetric material property of the fiber rope, the energy input from the low-frequency externally excited panel motions can be cascaded to the high-frequency localized motions. By this means, the dynamic response in the panel might be reduced so that the durability of the grid structure could be enhanced.

In terms of free vibration modes, it is noted that the BTR structure is free of any geometry constraint. It was found that a $1^{st}$ torsion mode frequency, 267.5 Hz, is significantly lower in this case than the major bending modes frequencies. The low torsion mode frequency may lead to large torsional deformation in dynamic response. Additional carbon ropes may need to be added in order to achieve higher torsion stiffness. On the other side, the low torsional stiffness might be a desired characteristic for some special applications. From the free vibration modes, the global bending modes and the local frame modes coexist in a relatively narrow frequency domain, from 6788 Hz to 7994 Hz.

For comparison, it was discovered that the first torsion modal frequency of the aluminum plate, 1576 Hz, is much higher than the one of the BTR structure. But, the BTR structure has much higher natural frequencies for the major bending modes than that of the aluminum plate. As the conclusion obtained from the static analyses, the BTR structure effectively improved the out-of-plane bending stiffness compared to the equivalent aluminum plate.

FIG. 7 illustrates an extension of the BTR concept to develop a composite armor, which consists of stuffer, fiber ropes, woven fiber panels, and ceramic layers. Since the BTR structure is ultra-light, the proposed composite armor would benefit the future combat system in the total weight reduction as well as in the energy absorption. The carbon-rope reinforcement plan is optimized to withstand the actual impact.

Figure 9:
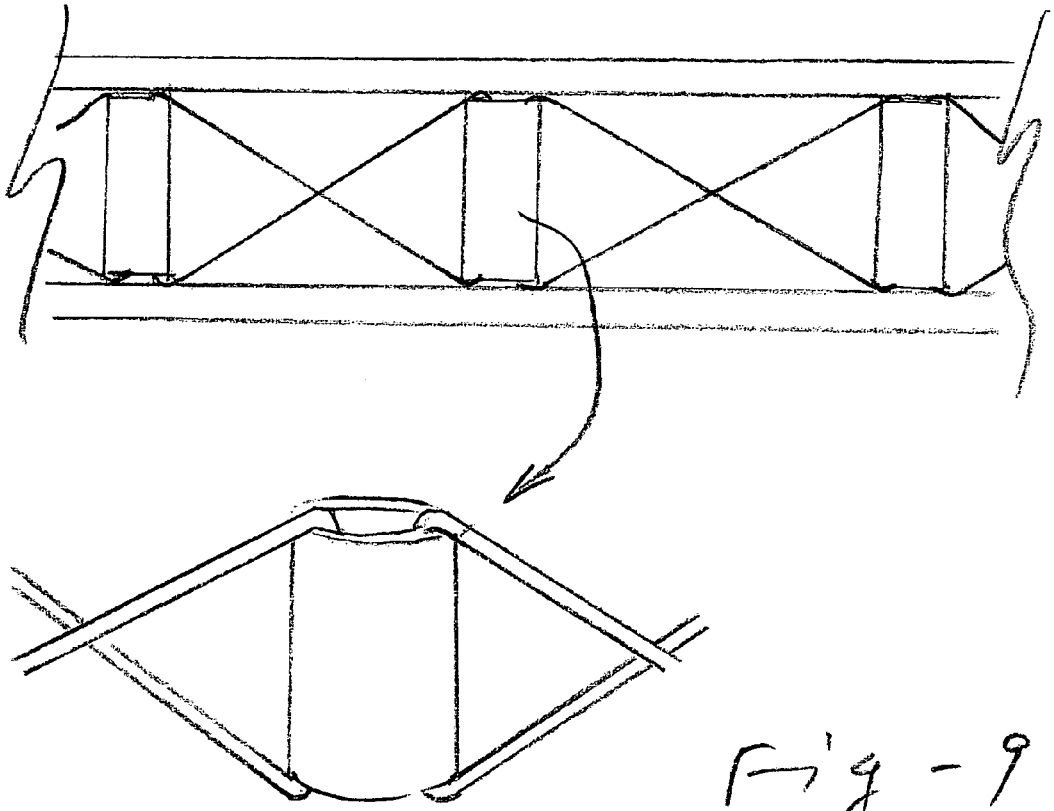
FIG. 9 shows how fiber elements may be passed through stuffer tubes.
Figure 10:
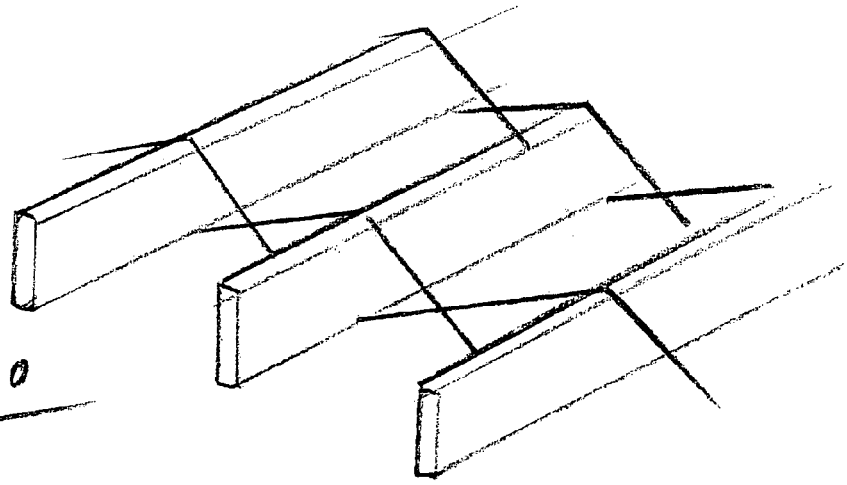
FIG. 10 shows elongated panel stuffer members.
Figure 11:
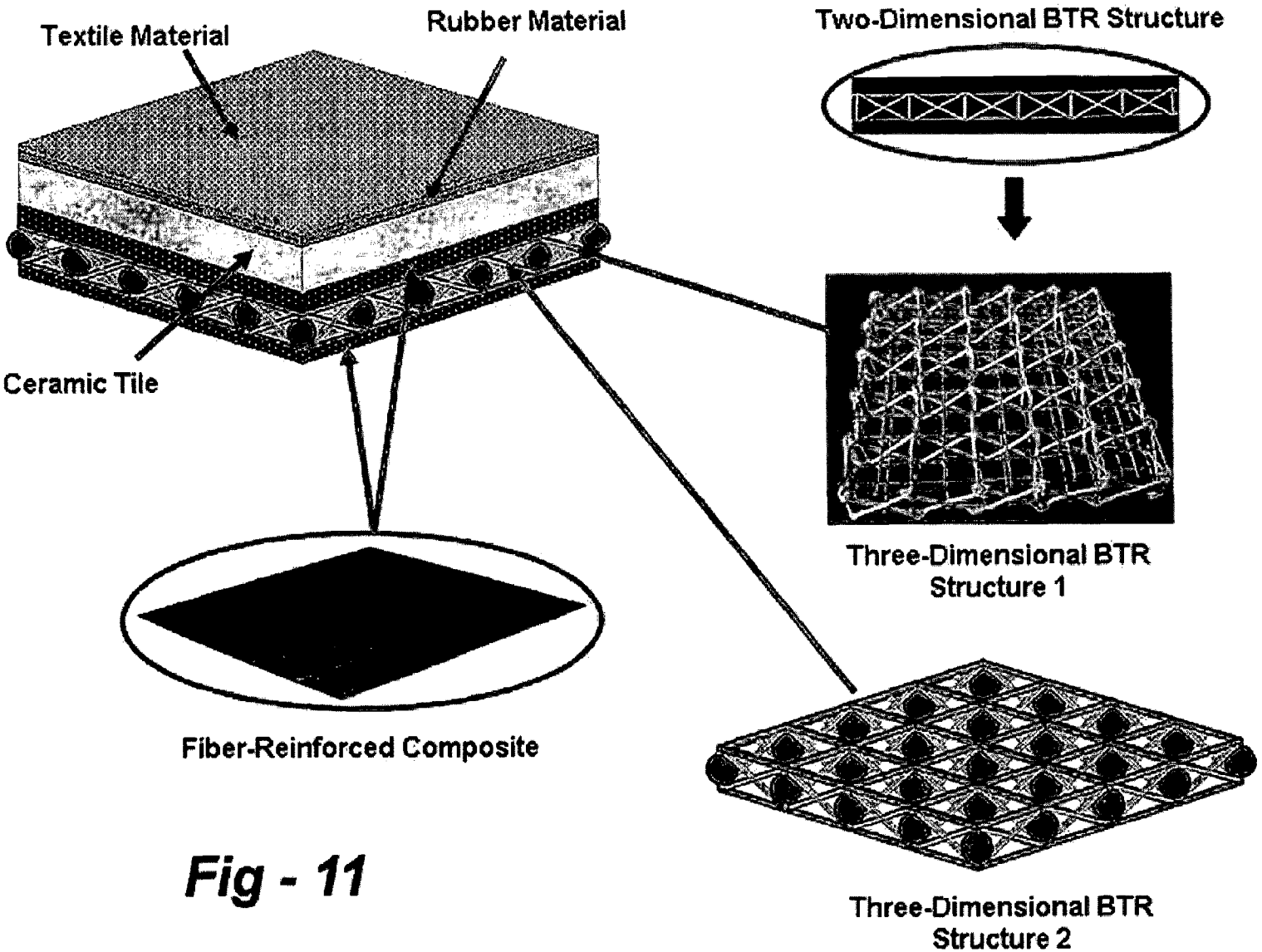
FIG. 11 shows a sandwich structure using spheroid stuffer members.

FIG. 8 illustrates potential knot designs for assembling different fiber-rope composites. In one BTR structure, the carbon ropes are stitched to the frame structure. A premeditated knot design will enhance the overall structure performance, especially the mechanical strength under the out-of-plane bending loads. FIG. 9 shows how fiber elements may be passed through stuffer tubes. FIG. 10 shows elongated panel stuffer members. FIG. 11 shows a sandwich structure using spheroid stuffer members.

Figure 12:
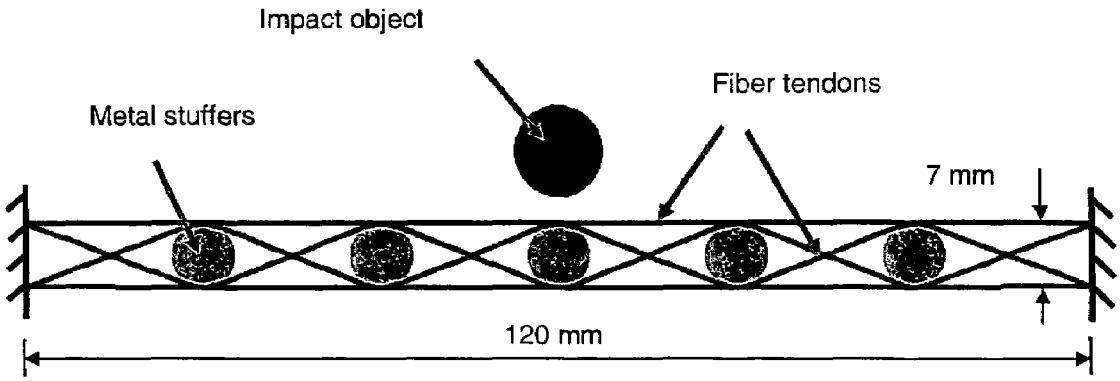
FIG. 12 shows a sample composite grid structure for multi-stage stability illustration.

An advantage of the BTR composite is the use of embedded fiber tendons. When a load carrying carbon-fiber tendon in a well-designed BTR composite is broken, the neighboring fiber tendons can act as the safety members to reserve the integrity of the whole BTR structure provided the tendons are properly placed. A two-dimensional example simulation is shown in FIG. 12 to illustrate the concept of multi-stage stability. Five metallic beads are utilized as the stuffers in a braiding process to form a woven lattice composite. The integrity of the composite structure is supported by the pre-tension of the tendons. When a rigid object is impacted on the composite, the deformation of the structure and the corresponding tension force in the tendon can be obtained by using a nonlinear cable model.

FIG. 13 illustrates the basic concept of the multi-stage stability in the BTR composite structure. The maximum permissible tensile force in the tendons is 3,800 N, which is a typical value for a carbon-fiber rope with 1.0 $mm^2$ cross section area. In FIG. 13A, the flying object hits the composite grid structure, the maximum deflection of the composite structure becomes 2.5 mm. It is seen that the tension in the master tendon is close to the strength limit, and the neighboring tendon is going to take effect in the next stability stage. In FIG. 13B, the stability stage B reaches its limit, the red fiber is going to break, while the cyan neighboring fiber is supposed to act in stability stage C.

Figure 13A:
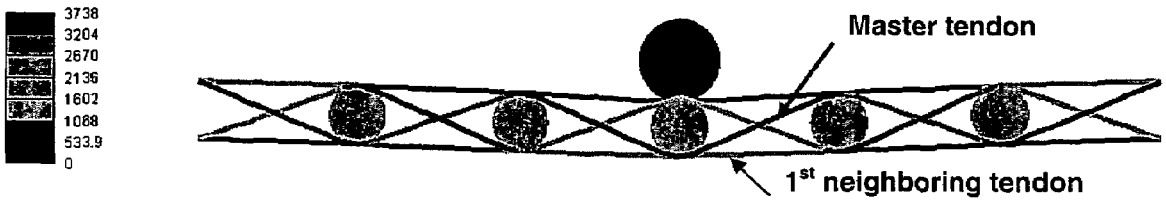
FIG. 13A shows a stability stage A wherein all the tendons are impact, the maximum deflection is 2.5 mm.
Figure 13B:
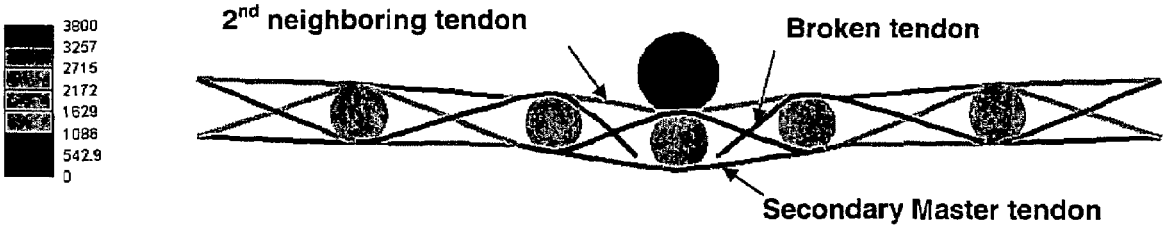
FIG. 13B shows stability stage B, the first master tendon is broken, the first neighboring tendon becomes the master tendon, the maximum deflection is 4.3 mm.
Figure 13C:
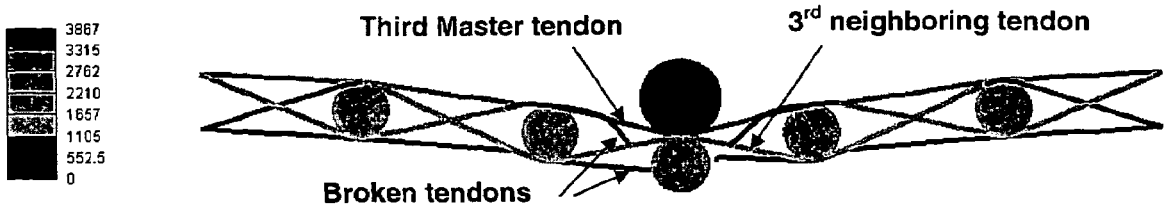
FIG. 13C shows stability stage C, the first and second master tendons are broken, the second neighboring tendon becomes the master tendon, the maximum deflection is 8.3 mm.
Figure 13D:
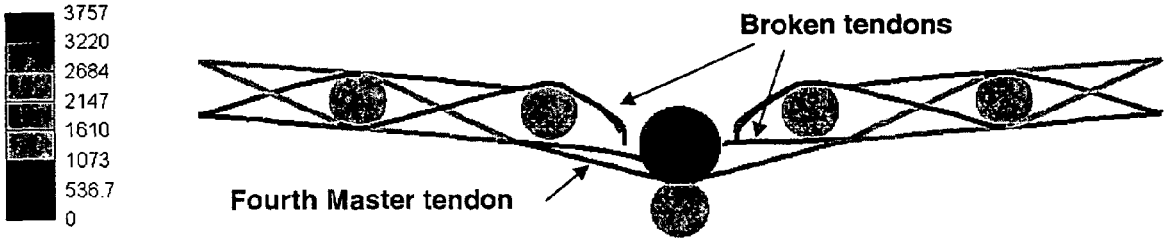
FIG. 13D shows stability stage D, all master tendons are broken except the third neighboring tendon now becomes the master tendon, the maximum bending deflection is reached as 16.0 mm.

FIG. 13C shows the stability stage C. It is seen that the central metal stuffer is separated from the fiber tendon net, while the net is still stable with the automatic position adjust of the remaining four metal stuffers. In FIG. 13D, the final stability stage is reached, and the maximum bending deflection of the composite structure is 16 mm.

Figure 14:
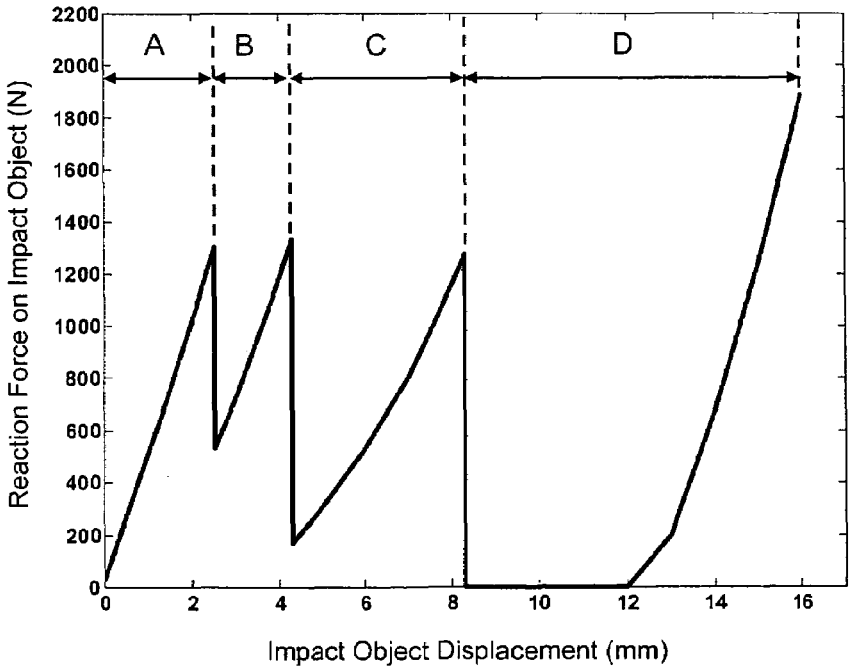
FIG. 14 is a graph that illustrates reaction force on the impact object versus impact object displacement.

The reaction force on the impact object is shown in FIG. 14. In the four stability stages, the reaction force in stage A and stage B are almost linear. In the last two stability stages, the BTR composite structure can still provide sufficient bending stiffness. FIG. 14 evidences the existence of multi-stage stability and the effectiveness of the fiber tendons in the BTR composite structure. Note that the sample composite in FIG. 12 may be easily manufactured. The fiber tendons can also be incorporated into any metallic grid structure to realize the multi-stage stability. In a practical application, several layers of the proposed BTR structure (in FIG. 12) can be stacked together to provide even better out-of-plane performance when needed.

I claim:

1. A biomimetic tendon-reinforced (BTR) composite structure, comprising:

a plurality of parallel, spaced-apart rigid stuffer members of substantially equal height, each stuffer member having an upper end and a lower end, and wherein the upper ends and the lower ends of the stuffer members are arranged along upper and lower parallel lines, respectively; and a plurality of fiber elements, including one fiber element that connects to the upper and lower ends of adjacent stuffer members in alternating fashion, and another fiber element that connects to the opposite ends of the same stuffer members in alternating fashion, such that the fiber elements criss-cross each other between the stuffer members.

2. The structure of claim 1, wherein the stuffer members and fiber elements are embedded in a matrix material.

3. The structure of claim 1, wherein the stuffer members and fiber elements are embedded in an epoxy resin.

4. The structure of claim 1, wherein the stuffer members are rods, tubes, ellipsoids or spheres.

5. The structure of claim 1, wherein the stuffer members are metal, ceramic or plastic.

6. The structure of claim 1, wherein the stuffer members are spaced apart at equal distances or at variable distances determined through optimization.

7. The structure of claim 1, wherein the fiber elements are carbon fibers, nylon, aramid fibers, glass fibers, plant fibers; or metal wires.

8. The structure of claim 1, wherein:

the stuffer members are tubes; and the fiber elements run through the tubes.

9. The structure of claim 1, wherein the fiber elements are tied to the ends of the stuffer members.

10. The structure of claim 1, wherein the fiber elements are tied to one another where they criss-cross, forming joints.

11. The structure of claim 1, further including a panel bonded to the upper or lower ends of the stuffer members.

12. The structure of claim 1, wherein:

the stuffer members are arranged in two-dimensional rows such that the upper and lower ends of the members respectively define upper and lower surfaces; and further including material bonded to one or both of the surfaces.

13. The structure of claim 1, wherein:

the stuffer members are arranged in two-dimensional rows such that the upper and lower ends of the members respectively define upper and lower surfaces; and further including a solid panel bonded to one or both of the surfaces.

14. The structure of claim 1, wherein:

the stuffer members are arranged in two-dimensional rows such that the upper and lower ends of the members respectively define upper and lower surfaces; and further including a mesh panel bonded to one or both of the surfaces.

15. The structure of claim 1, wherein:

the stuffer members are arranged in two-dimensional rows such that the upper and lower ends of the members respectively define upper and lower surfaces; and further including additional fiber elements connecting the ends of the members.

16. The structure of claim 12, wherein the stuffer members and fiber elements are embedded in a matrix material.

17. The structure of claim 12, wherein the stuffer members and fiber elements are embedded in an epoxy resin.

18. The structure of claim 12, wherein the stuffer members are rods, tubes, or spheres.

19. The structure of claim 12, wherein the stuffer members are metal, ceramic or plastic.

20. The structure of claim 12, wherein the stuffer members are spaced apart at equal distances.

21. The structure of claim 12, wherein the fiber elements are carbon fibers.

22. The structure of claim 12, wherein:

the stuffer members are tubes; and the fiber elements run through the tubes.

23. The structure of claim 12, wherein the fiber elements are tied to the ends of the stuffer members.

24. The structure of claim 12, wherein the fiber elements are tied to one another where they criss-cross, forming joints.

* * * * *